United States Patent [19]

Yamaguchi

[11] 4,352,387

[45] Oct. 5, 1982

[54] PROCESS FOR PRODUCING A HOLLOW CAST PRODUCT

[75] Inventor: Shinjiro Yamaguchi, Kawaguchi, Japan

[73] Assignee: Sankyo Oilless Industry, Inc., Fuchu, Japan

[21] Appl. No.: 42,130

[22] Filed: May 24, 1979

[51] Int. Cl.[3] ..... B22D 29/00

[52] U.S. Cl. ..... 164/132; 249/59; 249/183

[58] Field of Search ..... 164/132; 249/59, 183

[56] References Cited

U.S. PATENT DOCUMENTS

| | | | |
|---|---|---|---|
| 2,045,556 | 6/1936 | Almen | 249/62 |
| 2,480,899 | 9/1949 | Bond | 249/59 |
| 3,814,565 | 6/1974 | Cahour et al. | 249/183 X |

FOREIGN PATENT DOCUMENTS

| | | | |
|---|---|---|---|
| 23319 | 11/1930 | Australia | 249/183 |
| 374488 | 6/1907 | France | 249/183 |
| 554743 | 1/1957 | Italy | 249/183 |
| 11140 | of 1891 | United Kingdom | 249/183 |
| 334006 | 3/1972 | U.S.S.R. | 164/132 |

*Primary Examiner*—R. L. Spruill
*Assistant Examiner*—J. Reed Batten, Jr.
*Attorney, Agent, or Firm*—Koda and Androlia

[57] ABSTRACT

A process for producing a hollow cast product in which a hollow flexible mandrel is placed into the crucible of a mold with one end of the mandrel extending out of the mold, molten metal is introduced into the mold crucible and left to solidify in the crucible and the mandrel is removed from the mold to thereby form a hollow cast product having a bore which has the smooth or concavo-convex peripheral surface and is straight, bent or meandering.

5 Claims, 8 Drawing Figures

PROCESS FOR PRODUCING A HOLLOW CAST PRODUCT

BACKGROUND OF THE INVENTION

This invention relates to a process for producing a hollow cast product by the use of a hollow flexible mandrel in the crucible of a mold.

There have been proposed and practically employed a number of processes for producing hollow cast products and one of the prior art processes for producing hollow cast products employs a core in the crucible of the mold. However, since the prior art core employed in the process is formed of casting sand, gas generates during the production of a hollow cast product and such gas is required to be discharged by bending the core. If the gas discharge is insufficient, difficulties such as core blowing and formation of air cell honeycomb and/or casting honeycomb occur. In addition, it is quite difficult to produce a small diameter cast tube having a bent or meandering bore by the use of the core in the crucible of the mold.

The so-called centrifugal casting process which produces a hollow cast product by the utilization of centrifugal force produced in a mold without a core has been known. However, although this casting process eliminates the step of gas discharge because the process does not use the core, it is impossible to produce a hollow cast product having a bent or meandering bore.

Furthermore, in order to produce a small and uniform diameter hollow cast product such as a pipe product, the so-called draw mold and sweeping mold type casting processes have been proposed, but the processes require complicated production steps in the production of hollow cast products.

Furthermore, there has been also known the casting process in which a hollow cast tube is produced by the use of a metal pipe in the crucible of a mold, but this process has the disadvantage that a small clearance is formed between the tube being cast and the metal pipe.

SUMMARY OF THE INVENTION

The present invention is directed to a process for producing a hollow cast product which essentially comprises the steps of positioning a hollow flexible mandrel or core in a desired disposition within the crucible of a mold, introducing molten metal into the crucible and allowing the metal to solidify and removing the mandrel by pulling the mandrel after the solidification of the cast metal to thereby provide a hollow cast product.

Therefore, one object of the present invention is to provide a novel and improved process for producing a hollow cast product which effectively eliminates the difficulties inherent in the conventional processes for producing hollow cast products in a simple manner and at less expense.

Another object of the present invention is to provide a process for producing a hollow cast product having a bent or meandering bore as desired by the use of a hollow flexible mandrel instead of the conventional core in the crucible of a mold in a quite simple manner.

Another object of the present invention is to provide a process for producing a hollow cast product by the use of a hollow flexible mandrel in the crucible of a mold which produces no gas so as to eliminate the step of gas discharge and forms no honeycomb.

A further object of the present invention is to provide a process for producing a hollow cast product which comprises the steps of positioning a hollow flexible mandrel having the concavo-convex peripheral surface in the crucible of a mold, filling the concaves in the peripheral surface of the mandrel up with casting sand to smoothen the peripheral surface, introducing molten metal into the crucible of the mold and allowing the metal to solidify and removing the mandrel from the mold by pulling the same to thereby provide a hollow cast product.

The above and other objects and attendant advantages of the present invention will be more readily apparent to those skilled in the art from a reading of the following detailed description in conjunction with the accompanying drawings which show preferred embodiments of the present invention for illustration purpose only, but not for limiting the scope of the same in any way.

BRIEF DESCRIPTION OF THE DRAWINGS

The accompanying drawings show preferred embodiments of the invention for illustration purpose only in which.

PREFERRED EMBODIMENTS OF THE INVENTION

Figure 1:
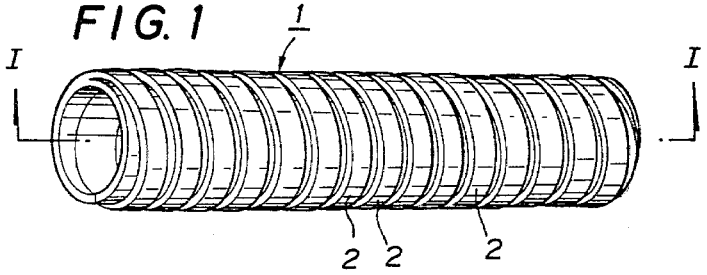
FIG. 1 is a perspective view of a hollow flexible mandrel for use in the production of a hollow cast product in accordance with the process of the present invention.
Figure 2:
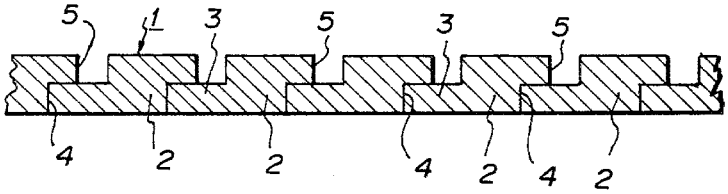
FIG. 2 is an enlarged longitudinally sectional view substantially taken along the line I—I of FIG. 1.

The present invention will be now described referring to the accompanying drawings and more particularly, to FIGS. 1 and 2 in which a first hollow flexible mandrel for use in the production of a hollow cast product in accordance with the process of the present invention is shown. The hollow flexible mandrel or core is generally shown by reference numeral 1 and comprises a single helically wound metal strip having a stepped cross-section as shown in FIG. 2. The hollow flexible mandrel 1 includes a plurality of windings 2, 2, 2 . . . each having a shoulder 3 and a recess 4 and the windings are so arranged that the shoulder 3 of each winding 2 is partially received in the recess 4 of the respectively adjacent winding so as to define a groove 5 between the respectively adjacent windings 2. The hollow flexible mandrel may be formed of brass or steel which is capable of standing against a particular casting temperature depending upon the type of metal from which a hollow cast product is produced.

Figure 3:
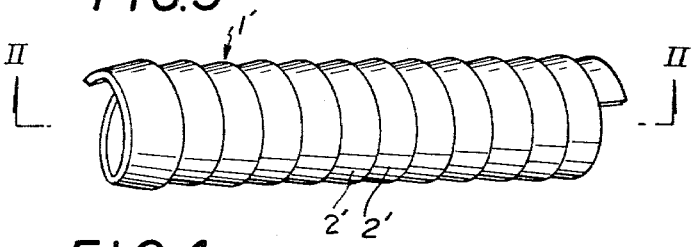
FIG. 3 is a perspective view of a modified hollow flexible mandrel for use in the production of a hollow cast product in accordance with the process of the present invention.
Figure 4:
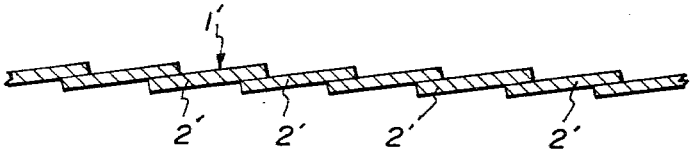
FIG. 4 is a longitudinally sectional view taken substantially along the line II—II of FIG. 3.
Figure 5:
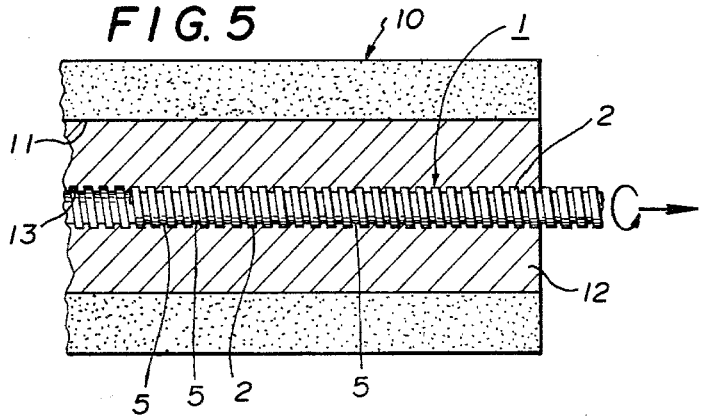
FIG. 5 is a longitudinally sectional view of a mold in the crucible of which a straight hollow cast product is produced by the use of the hollow flexible mandrel as shown in FIGS. 1 and 2.

Now turning to FIGS. 3 and 4 in which a second or modified hollow flexible mandrel for use in the production of a hollow cast product in accordance with the process of the present invention is shown. The second hollow flexible mandrel is generally shown by reference numeral 1' and comprises a single helically wound plain metal strip. The hollow flexible mandrel 1' includes a plurality of windings 2', 2', 2' . . . and the windings are so arranged that each winding partially overlaps the respectively adjacent winding.

In the production of a hollow cast product in accordance with the process of the present invention by the use of the hollow flexible mandrel 1 as shown in FIGS. 1 and 2, the mandrel 1 is placed into the cylindrical crucible 11 in a mold 10 with the axis of the mandrel extending coaxial with the axis of the mold and one end of the mandrel extending out of the mold and molten metal is then introduced from an external source (not shown) into the crucible 11. The molten metal is left as it is until the metal solidifies sufficiently. After the metal has solidified sufficiently, the hollow flexible mandrel 1 is then removed from the mold 10 by pulling the extended end of the mandrel so as to maintain the mandrel in its original configuration to thereby provide a hollow cast product 12 having a concavo-convex bore 13. In the embodiment described hereinabove, since the hollow flexible mandrel 1 has a plurality of grooves 5 defined between the adjacent windings 2, when the mandrel 1 is removed from the mold 10 after the hollow cast product has been formed therein, the mandrel can be easily removed from the mold 10 by turning the mandrel in the direction opposite to the orientation of the windings.

Since the hollow flexible mandrel 1 is wound helically, after the hollow cast product 12 has been formed, if desired, the mandrel 1 can be removed from the mold 10 by pulling the mandrel at one end with a high force so as to unwind the mandrel 1.

Figure 6:
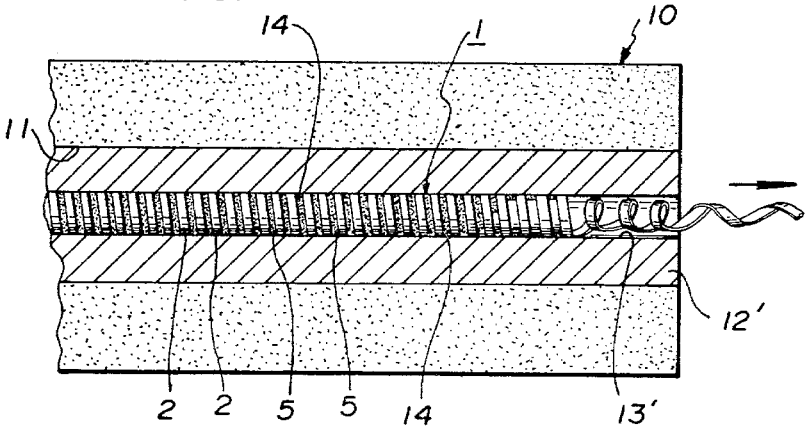
FIG. 6 is similar to FIG. 5, but shows a different hollow flexible mandrel removal manner.

In the embodiment as shown in FIG. 6, prior to the introduction of molten metal into the mold crucible 11, the grooves 5 defined between the adjacent windings 2 is filled up with casting sand 14 to smoothen the peripheral surface of the hollow flexible mandrel 1 and the mandrel is positioned within the crucible 11 with the axis of the mandrel disposed coaxial with the axis of the crucible and one end thereof extending out of the mold. Thereafter, molten metal is introduced into the crucible 11 to form a hollow cast product 12' having a smooth bore 13'. After the hollow cast product has solidified sufficiently, the mandrel 1 is pulled at one end with a high force to remove the mandrel from the mold 10 while unwinding the mandrel. As the mandrel 1 is removed, the casting sand 14 filling up the grooves 5 can be easily removed from the formed hollow cast product 12'.

Figure 7:
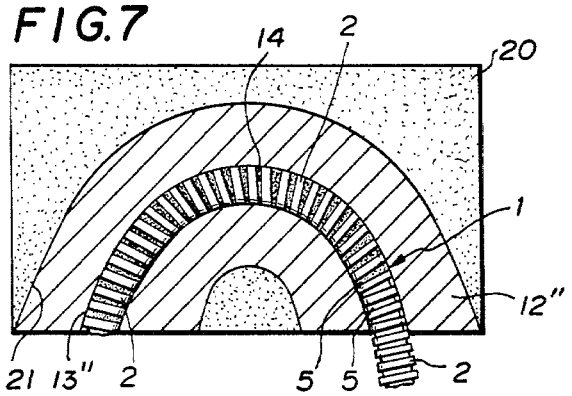
FIG. 7 is a cross-sectional view of a modified mold in which a hollow cast product having a horseshoe-shape is produced.

FIG. 7 shows a further modified embodiment of the process of the invention and in this embodiment, the mold 20 employed has the semicircular crucible 21 and the hollow flexible mandrel 1 is placed into the crucible by bending the mandrel following the contour of the crucible 21 with one end of the mandrel extending out of the mold 20 to be exposed to the atmosphere. Thereafter, molten metal is introduced into the mold crucible 21 and then left as it is until the metal solidifies sufficiently. After the solidification of the metal, the mandrel 1 is removed from the mold by pulling the mandrel at the exposed end.

Figure 8:
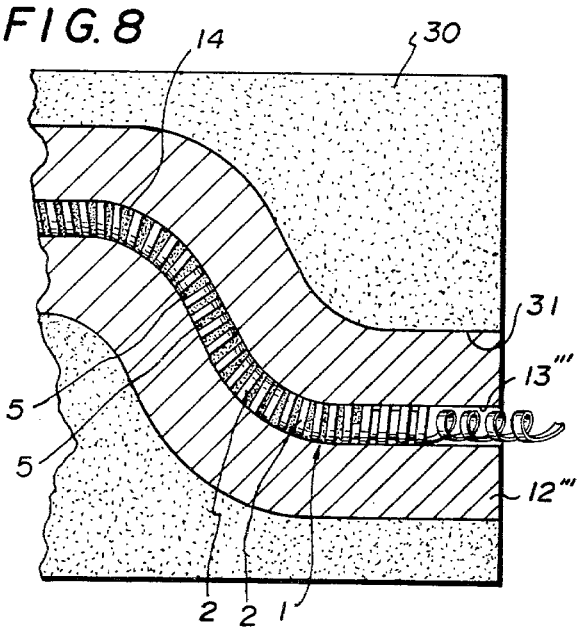
FIG. 8 is a cross-sectional view of a further modified mold in which a hollow cast product having a meandering shape is produced.

FIG. 8 shows a still further modified embodiment of the process of the invention and in this embodiment, the mold 30 employed has the meandering crucible 31 and the hollow flexible mandrel 1 is placed into the crucible by bending the mandrel following the contour of the crucible 31 with one end of the mandrel extending out of the mold to be exposed to the atmosphere. Thereafter, molten metal is introduced into the crucible 31 and left as it is until the metal solidifies sufficiently to form a hollow cast product 12''' having a meandering bore 13''' therein. The mandrel 1 is then removed from the mold 30 by pulling the exposed end with a high force so as to unwind the mandrel 1. In the embodiments as shown in FIGS. 7 and 8, the grooves 5 may be filled up with casting sand 14 as described in connection with the embodiment of FIG. 6 whereby the hollow cast products 12'' and 12''' having the smooth bores 13'' and 13''', respectively. Although not shown, as desired or necessary, the hollow flexible mandrel can be positively held in position within the mold crucible by means of suitable support means.

In the foregoing, although description has been made of the use of the hollow flexible mandrel 1 as shown in FIGS. 1 and 2, it will be appreciated that the hollow flexible mandrel 1' as shown in FIGS. 3 and 4 can be employed in the same manner as mentioned hereinabove.

While several embodiments of the invention have been shown and described in detail, it will be understood that the same are for illustration purpose only and not to be taken as a definition of the invention, reference being had for the purpose to the appended claims.

What is claimed is:

1. A process for producing a hollow cast metal product comprising the steps of positioning a hollow flexible mandrel in a crucible of a mold with one end of the mandrel extending out of the mold, said hollow flexible mandrel comprising a single helically wound metal strip including a plurality of windings each having a shoulder and a recess with the shoulder of each winding being partially received in the recess of the respectively adjacent winding to thereby define grooves between the windings, to provide a concavo-convex peripheral surface of the mandrel, filling the concaves in the peripheral surface of the mandrel up with casting sand to provide a smooth peripheral surface on the mandrel, introducing molten metal into said crucible of the mold and allowing the metal to solidify and removing said hollow flexible mandrel from said mold by pulling the mandrel at one end to thereby provide a hollow cast product.

2. The process for producing a hollow cast product as set forth in claim 1, in which said removal of the hollow flexible mandrel is effected by pulling the mandrel at said one end while maintaining the mandrel in the original form.

3. The process for producing a hollow cast product as set forth in claim 1, in which said removal of the hollow flexible mandrel is effected by pulling the mandrel at said one end so as to unwind the mandrel.

4. The process for producing a hollow cast product as set forth in claim 1, in which said mold has a semicircular crucible and said hollow flexible mandrel is positioned in said crucible following the contour of the crucible to thereby provide a hollow cast product having a horseshoe-shaped bore therein.

5. The process for producing a hollow cast product as set forth in claim 1, in which said mold has a meandering crucible and said hollow flexible mandrel is positioned in said crucible following the contour of the crucible.

* * * * *